US005321310A

United States Patent [19]

Mizuki

[11] Patent Number: 5,321,310

[45] Date of Patent: Jun. 14, 1994

[54] APPARATUS AND METHOD FOR INCREASING ELECTRON FLOW

[76] Inventor: Mikiso Mizuki, 2824 Monte Verde Dr., Santa Maria, Calif. 93455

[21] Appl. No.: 791,465

[22] Filed: Nov. 13, 1991

Related U.S. Application Data

[63] Continuation-in-part of Ser. No. 410,728, Dec. 4, 1989, abandoned.

[51] Int. Cl.[5] ..... H01B 5/00

[52] U.S. Cl. ..... 307/104; 29/825; 174/117 FF; 174/133 B

[58] Field of Search ..... 307/104; 338/32 H; 174/133 B, 133 R, 117 R, 117 FF, 126.1, 126.2; 29/825

[56] References Cited

U.S. PATENT DOCUMENTS 2,988,650 6/1961 Weiss ..... 338/32 H
3,413,712 12/1968 Engel ..... 338/32 H
4,262,275 4/1981 DeMarco et al. ..... 338/32 H
4,584,552 4/1986 Suzuki et al. ..... 338/32 H

*Primary Examiner*—Jeffrey A. Gaffin
*Attorney, Agent, or Firm*—Ralph H. Dougherty

[57] ABSTRACT

A method for increasing electron flow and enhancing electrical conductivity in an electrical ribbon conductor by providing a plurality of parallel bridges spanning the ribbon conductor from one edge to the other, connecting them electrically, insulating the bridges from the surface of the ribbon conductor and from adjacent bridges, and generating or externally supplying a magnetic field along the direction perpendicular to the ribbon surface. Also disclosed is an electrical ribbon conductor apparatus which produces enhanced electrical conductivity, and has a two or three tiered structure with a plurality of parallel bridges spanning the ribbon conductor from one edge to the other, connecting the edges electrically, and insulated or spaced from the surface of the conductor and from adjacent bridges.

20 Claims, 6 Drawing Sheets

APPARATUS AND METHOD FOR INCREASING ELECTRON FLOW

CROSS REFERENCE TO RELATED APPLICATION

This application is a continuation-in-part of my copending U.S. patent application Ser. No. 07/410,728, filed Dec. 4, 1989,

BACKGROUND OF THE INVENTION

1. Field of the Invention

The present invention relates to a method for increasing electron flow in an electrical ribbon conductor, and an electrical ribbon conductor having an improved configuration which produces enhanced electrical conductivity.

2. Description of the Prior Art

When copper wire and ribbon are used in coil windings of electromagnets, transformers, electrical motors and generators, the amount of current flow is limited by Ohm's law, beyond which no improvement was feasible. Significantly improved electrical conductivity is presently achieved by using superconductors operating at cryogenic temperatures below 4° K., or high temperature superconductors at temperatures in the 70°–140° K. range (about the temperature of liquid nitrogen and above), but none is yet available to operate at room temperature. Superconductors require specialized plumbing, cooling devices, coolant, dewars, etc., and high maintenance costs are involved. In computer chip technology, the electron velocity is determined by the nature of semiconductor materials, and no accelerating device for electrons is used.

Weiss U.S. Pat. No. 2,988,650 teaches apparatus which utilizes semiconductor components installed in parallel as active elements, and which is used in the presence of a magnetic field for measuring, controlling, regulating, modulating, or other translating purposes. In contrast, the present invention does not involve any semiconductors. Although Weiss utilizes parallel circuitry, there is no other similarity to the present invention. The parallel installation of the Hall current bridges of the present invention span a ribbon conductor from one edge to the other, between which no designed potential differences should exist, except for the small resulting potential differences due to Hall current electron migration. Thus there is a radical difference between the parallel installation of the Weiss semiconductor devices and the present invention.

Applicant is unaware of any prior work in this particular domain of the shaping of electrical conductors for the purpose of enhancing electrical conductivity by increasing electron flow velocity.

The Illustrated Dictionary of Electronics, 4th ed., (1988) by Rufus P. Turner and Stan Gibilisco, sets forth on page 271 the definition of "Hall effect" as "A phenomenon observed in thin strips of metal and in some semiconductors: When a strip carrying current longitudinally is placed in a magnetic field that is perpendicular to the strip's plane, a voltage appears between opposite edges of the strip that, although it is feeble, will force a current through an external circuit. The voltage is positive in some metals (such as zinc) and negative in others (such as gold)."

It has been found that when a magnetic field oriented perpendicular to the ribbon surface is applied or self generated, the longitudinal electron velocity is increased if a transverse electron flow in the direction opposite of Hall current can be generated on a conductor ribbon. To accomplish this, Hall current is drained from the edge of electron accumulation and the drained electrons are transported to the other edge via parallel insulated bridges running across the ribbon surface, which are herein called Hall current bridges.

SUMMARY OF THE INVENTION

The present invention achieves enhanced electrical conductivity by increasing electron flow velocity when a self generated magnetic field or an externally supplied magnetic field is applied in the direction perpendicular to the ribbon surface of an improved ribbon conductor which is provided with a plurality of parallel Hall current bridges. These bridges drain Hall current and transport drained electrons towards the opposite electron-depleting edge of the ribbon conductor. The bridges connect both edges of the conductor electrically but they are insulated from the ribbon surface(s) and from adjacent conductor components. The electrical conductor may be used in coil/solenoid windings of electromagnets and other electromagnetic devices to achieve high performance and efficiency, and to increase electron flow velocity in electronics circuitry.

Three equations of electron velocity components appear on page 173 of Introduction to Solid State Physics, by C. Kittel, 5th edition, John Wiley, New York, 1976:

$$v_x = -(eT/m)E_x - W_c T v_y$$

$$v_y = -(eT/m)E_y + W_c T v_x$$

$$v_z = -(eT/m)E_z$$

where $W_c = eB/mc$ is the cyclotron frequency for the electron mass m with negative charge $-e$, and T is the collision time. The magnitude of the negative $v_x$ is increased by increasing $v_y$. The transverse $v_y$ is made more negative by the decreased value of $v_x$, but this produces a higher velocity electron being drained and transported via Hall current bridges, thus further increasing the magnitude of $v_x$. A cyclic argument is thus formed. The (x,y,z)-coordinates used in the equations are the x-axis along the current direction, (−x)-axis along migration direction, and z-axis along the magnetic field direction when a ribbon is lain along the x-axis on (x,y)-plane. Improved electrical conductivity, i.e., an increase in the magnitude of the electron flow velocity along the (−x)-axis, can be obtained by causing electrons to have a positive transverse velocity component along the y-axis (the opposite of Hall current electron migration). Positive transverse electron velocity along the y-axis is obtained by draining Hall current and transporting the drained electrons to the opposite electron depletion edge via Hall current bridges with a transport velocity close to or less than the magnitude of the electron velocity along x-axis and a function of the bridge pitch angle. The electron transport velocity on Hall current bridges can be determined only empirically. A theoretical estimate may be derived as follows. Since electrons have two different velocity vectors, one for those on the ribbon conductor, and the other for those on the bridges, first the weighted average of the two different velocity vectors must be obtained by using the weights as the relative frequency of finding electrons on the ribbon or on the bridges. Second, the x,y-axis velocity components are computed by decomposition of the weighted average velocity vector. Finally, the components must be renormalized by the relative frequency of finding electrons on the ribbon to account for the electrical conductivity through the improved conductor.

The y-axis velocity component of electrons on the bridges is approximated by the product of the cosine of the bridge pitch angle and the magnitude of the (−x)-velocity component of the electrons on the ribbon. If the relative frequency is, for example, ½, the weighting and renormalization cancel each other. The estimated y-axis velocity component is then the product of the cosine of the bridge pitch angle and the magnitude of the (−x)-velocity component minus the Hall current migration velocity component. The increase of electron velocity along the positive y-axis results in increased absolute electron flow velocity along the (−x)-axis. Since the density of free electrons on the ribbon remains constant, this yields an increased current flow through the improved ribbon conductor. When the electron absolute velocity along the (−x)-axis is increased, the electron velocity along the negative y-axis of Hall current electron migration is increased, thus requiring faster draining of congesting electrons at the accumulation edge.

Building Hall current bridges across a ribbon surface can be accomplished by making parallel cuts in a conductive metal tubing, such as copper, removing the cut material alternately, then flattening the tubing as described below.

In the case of a general electromagnetic application, spiral(s) of the improved ribbon conductor are constructed for the winding, and the individual ribbon's spiral surfaces are kept perpendicular to the magnetic core, including ferromagnetic core plates of conventional design and empty space in the case of a solenoid, and any other advanced design materials. To avoid short circuits, appropriately shaped insulator inserts may be fabricated and strategically placed between the surface of Hall current bridges and ribbon surfaces and/or between adjacent spiraled segments of the ribbon conductor. The insulator may be produced in segments for ease of insertion and overall installation, and may consist of ferromagnetic material with insulating coated surfaces to facilitate and increase penetration of the applied magnetic field lines throughout the ribbon width.

In electromagnet applications, increased current flow through the improved ribbon conductor produces a stronger magnetic field, which in turn yields a proportionally stronger contribution of the positive transverse current along the y-axis increasing the absolute electron velocity along the (−x)-axis. This again increases the electron velocity of Hall current with faster draining and increased transport velocity on the bridges, and thus further increases the absolute electron velocity along the (−x)-axis. This cyclic process will continue so long as positive overall electron velocity along the transverse y-direction is obtained and maintained.

Theoretically it can continue unbounded except for some unknown physical limitations. This feature allows useful applications to electromagnets, transformers, motors, generators, etc.

In direct current (DC) applications, all Hall current bridges of the improved ribbon conductor are placed on one surface of ribbon, and should have nearly the same width and the same pitch angle in parallel orientation. The pitch angle of the bridges must experimentally be chosen for an optimum performance. In alternating current (AC) applications, Hall current is always generated towards a specific edge of ribbon when the current flow and the generated magnetic field reverse the directions, not towards alternating edges from one edge to the other. Because of this, zero pitch angle Hall current bridges work with some efficiency. A three tiered structure may be constructed with Hall current bridges on both surfaces of a conductor ribbon with a pitch angle the same as the angle selected for DC application on one surface and the reverse pitch angle for those bridges constructed on the reverse surface of the ribbon as shown in FIG. 3. Such a conductor can readily be manufactured by bonding two DC conductors made from copper tubing back to back.

The increase of electron flow velocity may be implemented in integrated circuit (IC) technology by supplying an external magnetic field onto microscopic improved ribbon conductor fabricated on chips or on interconnects. The equivalent of the improved ribbon conductor can be produced using a standard etching-deposition process on substrates. Logical elements can then be operated at a faster clock rate than feasible on conventional integrated circuits using the same semiconductor materials.

The improved conductor ribbon can be used for plasma containment electromagnets, and thermonuclear fusion devices. In plasma containment, a toroidal or Tokamak chamber is surrounded by electromagnets incorporating the improved conductor ribbon to confine the orbit of the plasma within the chamber.

The improved conductor ribbon can also be used in fabrication of strong heavy duty electromagnets in lieu of expensive superconductor magnets for levitation and locomotion of magnetically levitated vehicles for high speed ground transportation. Electromagnets installed on the track and bottom of vehicles levitate the vehicles by magnetic repulsion. Additional linear induction motors similarly installed in appropriate positions on the track and on the vehicle provide vehicle locomotion.

OBJECTS OF THE INVENTION

The principal object of the invention is to provide an improved method for increasing electron flow and enhancing electrical conductivity in an electrical ribbon.

A further object of this invention is to provide an improved electrical ribbon conductor apparatus which produces enhanced electrical conductivity.

Another object of the invention is to provide improved electrical ribbon conductor apparatus for coil or solenoid winding of electromagnetic devices.

Another object of the invention is to provide improved electrical ribbon conductor apparatus for interconnects of ICs with an externally supplied magnetic field.

BRIEF DESCRIPTION OF THE DRAWINGS

The foregoing and other objects will become more readily apparent by referring to the following detailed description and the appended drawings in which:

FIG. 11 is a perspective view of a substrate with parallel strips of conductive metal deposited thereon.

FIG. 12 is a perspective view of the assembly of FIG. 9 with insulating material installed thereon.

FIG. 13 is a perspective view of the assembly of FIG. 10 with a final deposit of conductor metal thereon.

DESCRIPTION OF THE PREFERRED EMBODIMENTS

Figure 1:
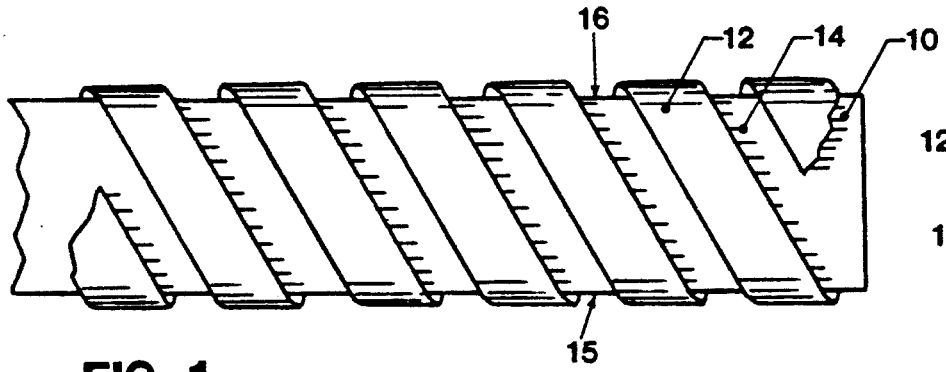
FIG. 1 is a plan view of an electrical conductor ribbon with Hall current bridges installed on a single surface.
Figure 2:
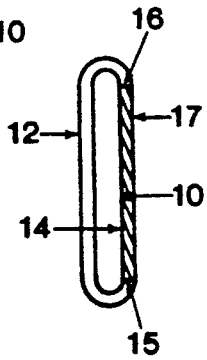
FIG. 2 is an end view of the electrical conductor ribbon of FIG. 1 with Hall current bridges installed on a single surface.
Figure 3:
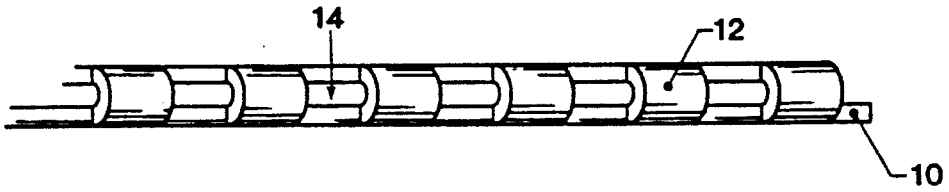
FIG. 3 is a front view of the electrical conductor ribbon of FIG. 1 with Hall current bridges installed on a single surface.
Figure 4:
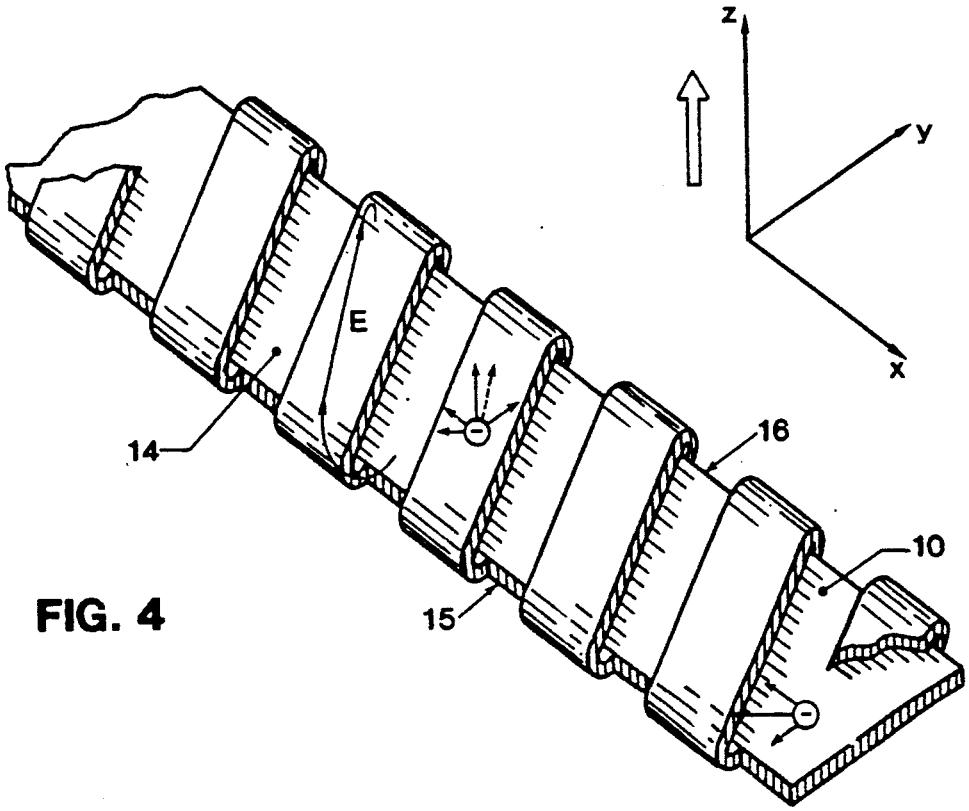
FIG. 4 is a perspective view of the electrical conductor ribbon of FIG. 1 with Hall current bridges installed on a single surface.
Figure 5:
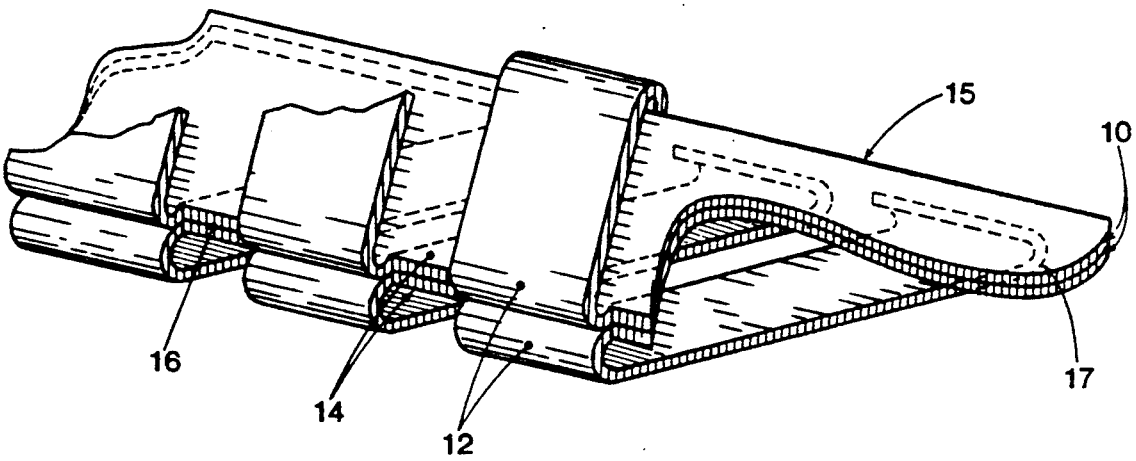
FIG. 5 is a partially cutaway perspective view of an electrical conductor ribbon with Hall current bridges constructed across both upper and bottom surfaces of the ribbon.

FIGS. 1 through 4 show the improved ribbon conductor 10 with Hall current bridges 12 installed on a single conductor surface 14 in accordance with present invention. The basic electrical conductor ribbon 10 is augmented with a plurality of Hall current bridges 12 diagonally extending from one edge 15 of the ribbon over the main surface 14 to the other edge 16 of the ribbon 10, thereby electrically connecting both edges 15,16. The Hall current bridges 12 are insulated from the main ribbon surface 14 by physical separation, as an air gap, for example, but non-conductive electrical insulator material, such as unprepared printed circuit base board or a bundle of glass fibers can be inserted if so desired. As seen in FIG. 2, the Hall current bridges 12 are arranged across the main surface 14 of the ribbon 10. In FIG. 4 the x-axis represents the longitudinal current flow direction, the (−y)-axis represents the Hall current electron flow direction in presence of a magnetic field oriented along the z-axis. The Hall current bridges appear as the diagonal strip conductors connecting the edges 15,16 of the ribbon 10 across the surface 14. Vectorial decompositions into longitudinal and transverse components of the electron velocity vectors are shown for the electrons on the ribbon and on the bridges. The Hall current flows from edge 15 along electron path E through the Hall current bridge 12 to edge 16 of the ribbon 10. For AC applications, Hall current bridges of zero pitch angle may function, but a similar set of Hall current bridges may be fabricated on the reverse or bottom side 17 of the ribbon 10 in addition. FIG. 5 shows an improved ribbon conductor with Hall current bridges 12 installed across both top and bottom surfaces 14,17 connecting edges 15,16. To fabricate Hall current bridges on both top and bottom surfaces, the improved ribbon conductor of a given bridge pitch angle is first produced by the method illustrated by FIG. 6 and 7. When the prepared ribbon conductor is turned upside down, the Hall current bridges across the bottom surface 17 have the opposite pitch angle. Two improved ribbon conductors then may be bonded together back to back to form a single ribbon of double thickness with Hall current bridges spanning both surfaces as shown in FIG. 5.

Figure 6:
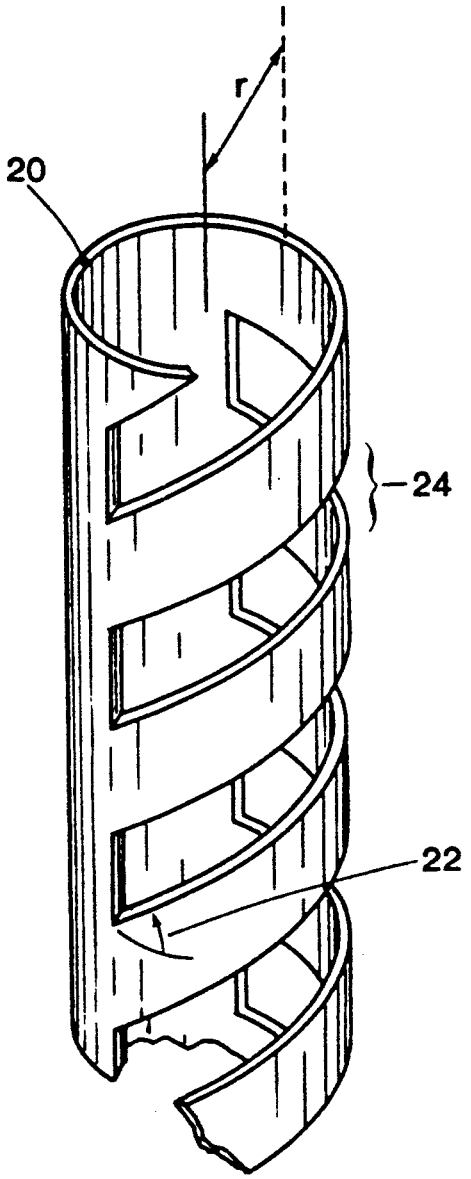
FIG. 6 is a perspective view of a portion of a round tube with cut out portions used for the manufacturing of Hall current bridges therefrom.
Figure 7:
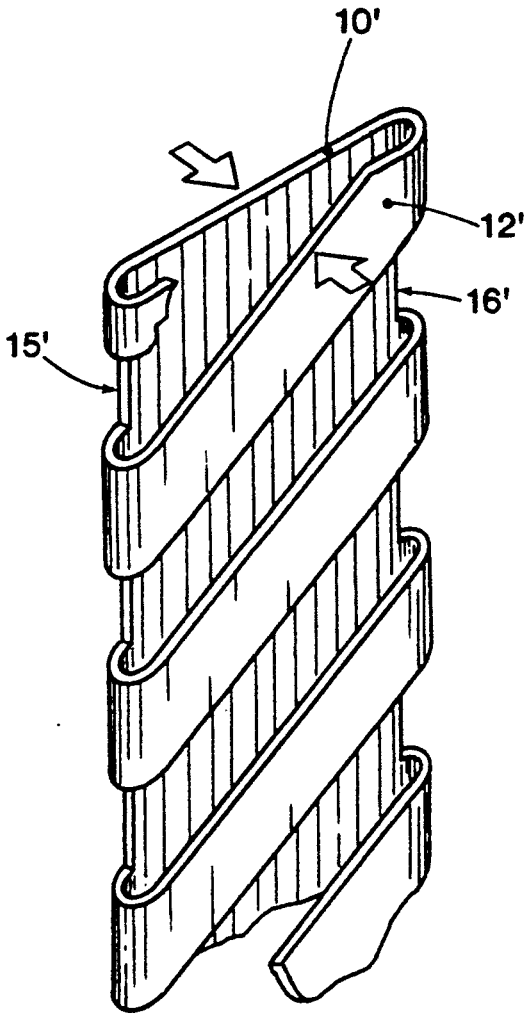
FIG. 7 is a perspective view of the tube of FIG. 6 after flattening.

FIGS. 6 and 7 show the method by which the bridges 12 of the improved conductor ribbon 10 can easily be manufactured from a conductive metal tubing 20 by making cut-outs at a chosen pitch angle 22 and thereafter flattening the tubing 20. When a tube of a radius r is used, after flattening the tubeing, a modified ribbon conductor of a width roughly equal to 3r is obtained. As shown in FIG. 6, diagonal cuts 24 are made in the direction from upper right to lower left on the tubing 20 slightly in excess of half the tube depth. The tilt (pitch) angle 22 of the diagonal cuts 24 are selected to achieve an optimum conductor performance for each specific application purpose. Subsequently the tubing 20 is flattened to form the flat shape shown in FIG. 7 whereby the unbroken or uncut side of the tubing 20 forms a continuous ribbon 10′ and the cut-out sides form parallel Hall current bridges 12′ connecting the edges 15′ and 16′. The bridges 12′ must remain isolated from the surface of the ribbon 10′ for insulating purpose.

Figure 8:
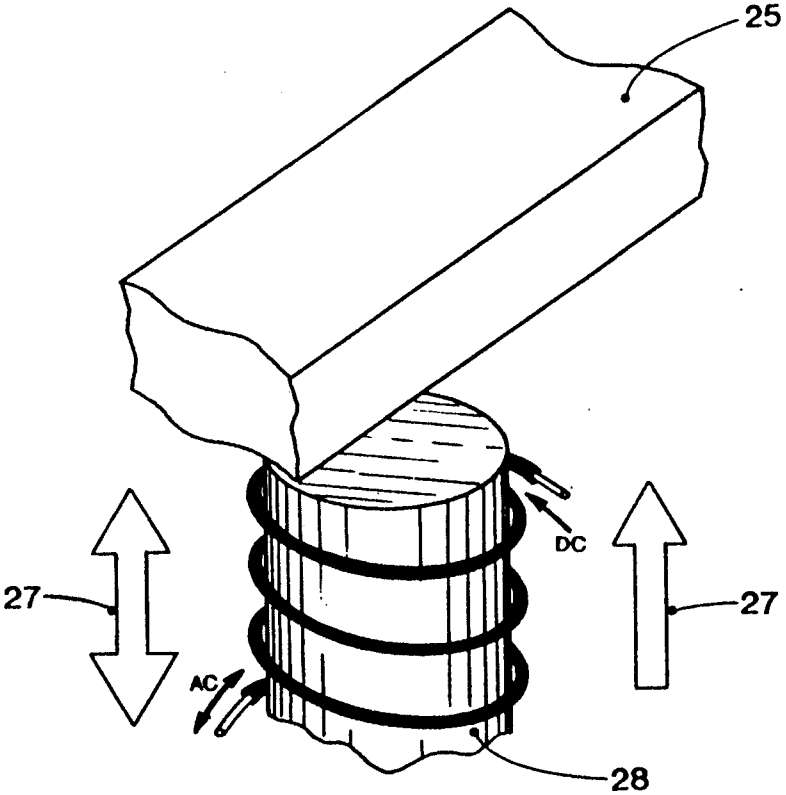
FIG. 8 is an isometric view of electromagnet applying an external magnetic field to a ribbon conductor.

FIG. 8 shows a general conceptual approach wherein the improved ribbon conductor 25 (either AC or DC as shown in FIGS. 1 through 5) is positioned with respect to an externally applied magnetic field 27 generated by electromagnetic 28 (using either AC or DC current).

Figure 9:
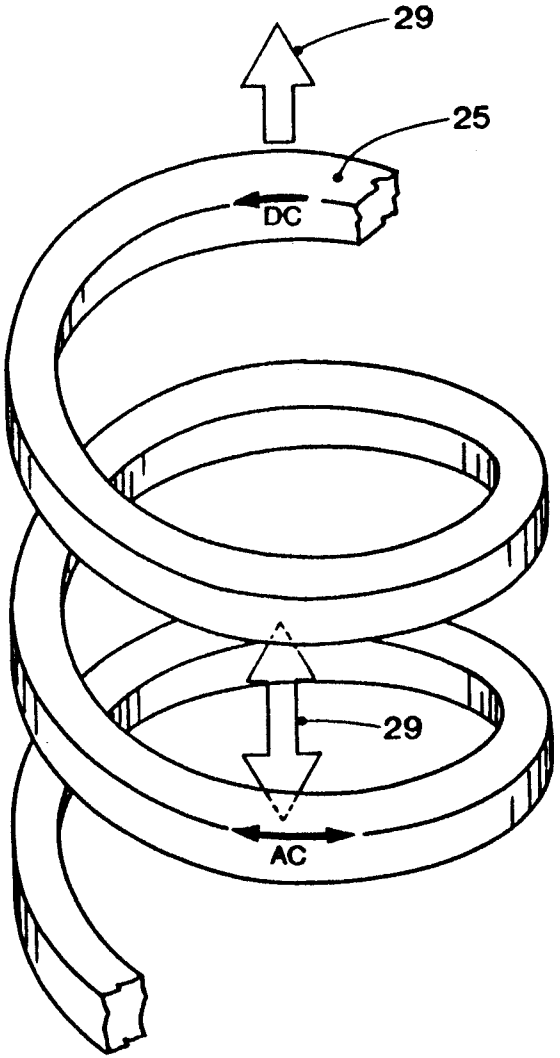
FIG. 9 is an perspective view of a spiral coiled ribbon conductor capable of generating a self induced magnetic field.

FIG. 9 shows a general conceptual approach wherein a self generated magnetic field (29) is produced by the spiral configuration of the ribbon conductor 25.

Figure 10:
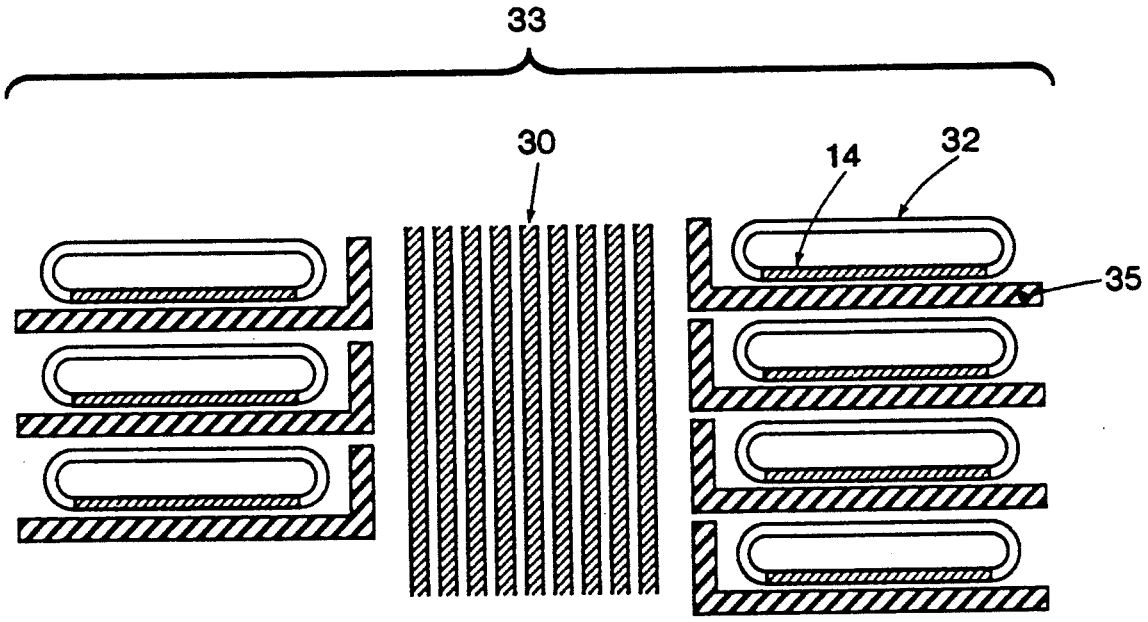
FIG. 10 is a cross section of a typical electromagnetic coil winding in which the improved ribbon conductor is wound around ferromagnetic core plates.

FIG. 10 shows a typical cross section of a spiral installation of the improved ribbon conductor as a coil wound around ferromagnetic core plates 30 of an electromagnet, a straight coil winding portion of transformer using the improved AC ribbon conductor 26, or the like. The winding of the invented ribbon conductor 32 is placed in such a manner that the ribbon surface 14 is maintained perpendicular to the core plates 30 to ensure that the self generated magnetic field is applied along the desired direction perpendicular to the ribbon surface. Insulating inserts 35 are arranged between the main surfaces of adjacent turns of the wound spiral of the improved conductor ribbon. Incorporating ferromagnetic powder in the insulator inserts 35 ensures that the magnetic field covers the entire width of the improved ribbon conductor.

A typical rectangular winding spiral of the improved conductor may be produced by the following steps. Each winding forms a flat ribbon segment occupying a portion of the surrounding space around the magnetic core. For the straight portion, segments produced from tubing as explained earlier are used. For corners of the spiral, quasi-square fan (or square) shaped plate conductor pieces are bonded to the base ribbon portions of the improved ribbon conductor segments to form a continuous spiral base ribbon piece. The four corners of the spiral are good places for positioning spacers with sliced cutouts for securing segments of the spiral rigidly to avoid inadvertent displacement of the installed spiral under shock and vibration. Insulator inserts 35 may take on quasi-shelf shape conformable to the improved ribbon conductor 32, made in segments in suitable lengths and are placed in position one by one as the spiral piece is installed around core 30 and secured inside a housing, not shown. Much wider and thinner improved ribbon conductor than shown can be installed in this coil/-solenoid design. The entire assemblage 33 may be immersed in cooling oil to dissipate the heat generated during the operation of the electromagnetic device.

Figure 13:
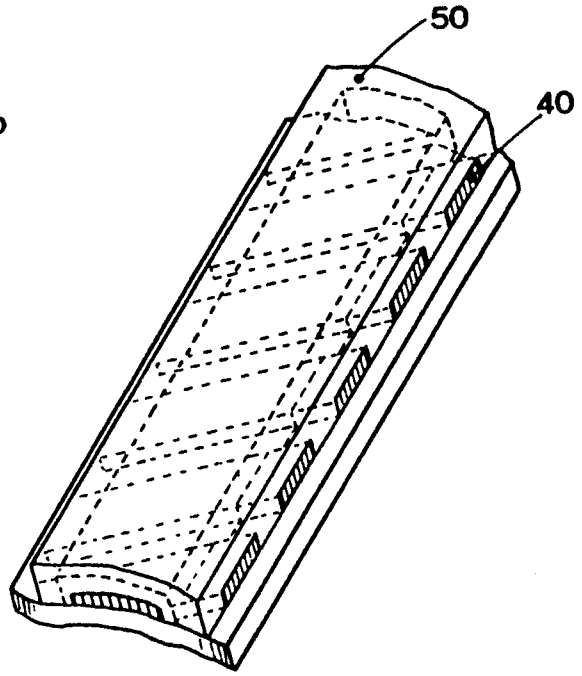
FIGS. 11 through 13 illustrate the manufacturing steps for making an improved ribbon conductor with Hall current bridges using IC fabrication procedures for interconnect components.
Figure 12:
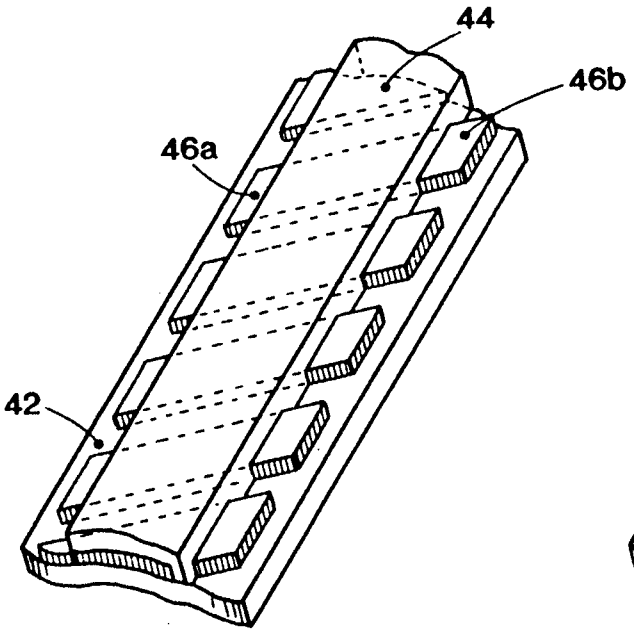
Figure 11:
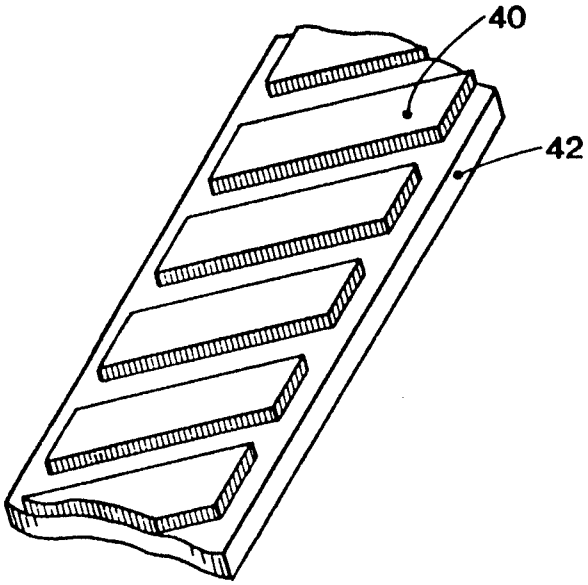

A method of manufacturing a microscopic version of the improved ribbon conductor as an IC interconnect is shown in FIGS. 11 through 13. In FIG. 11, a plurality of parallel diagonal strips 40 of conductive metal, such as aluminum, copper, silver or gold, are deposited on a non-conductive semiconductor substrate 42 of the IC with the orientation from upper right to lower left, and having substantially equal spacings therebetween. As shown in FIG. 12, insulation material 44, such as silicon, silicon compound, or other insulator, is then deposited onto the middle part of the diagonal strips 40 leaving both metal ends 46*a*, 46*b* exposed. FIG. 13 shows the final depositing of conductor metal 48, to cover the entire array of strips 40, including full coverage of the previously exposed ends 46*a*, 46*b* to form a continuous ribbon assembly 50, the deposited diagonal strip conductor metal 40 forming Hall current bridges. If necessary, the assembled product can be baked at a preselected temperature and cured at a rate to promote crystallization of the conductive metal.

SUMMARY OF THE ACHIEVEMENT OF THE OBJECTS OF THE INVENTION

From the foregoing, it is readily apparent that I have invented an improved method and apparatus for increasing electron flow and enhancing electrical conductivity in an electrical ribbon, an improved electrical ribbon conductor apparatus for coil or solenoid winding of electromagnetic devices, and for interconnects of integrated circuits with an externally supplied magnetic field.

It is to be understood that the foregoing description and specific embodiments are merely illustrative of the best mode of the invention and the principles thereof, and that various modifications and additions may be made to the apparatus by those skilled in the art, without departing from the spirit and scope of this invention, which is therefore understood to be limited only by the scope of the appended claims.

I claim:

1. A method for increasing electron flow and enhancing electrical conductivity in an electrical ribbon conductor by providing a plurality of parallel bridges spanning the ribbon conductor from one edge to the other, connecting the edges electrically, spacing the bridges from the surface of the ribbon conductor and from adjacent bridges, and supplying a magnetic field along the direction perpendicular to the ribbon surface.

2. A method according to claim further comprising enhancing electrical conductivity and increasing electron flow velocity by draining electrons migrating towards one ribbon edge and transporting the drained electrons to the other ribbon edge via the bridges when a magnetic field is applied in the direction perpendicular to the ribbon surfaces.

3. A method according to claim 1, further comprising insulating the bridges from the surface of the ribbon conductor.

4. A method according to claim 3, further comprising insulating the bridges from adjacent bridges.

5. An electrical conductor apparatus, comprising:

a ribbon electrical conductor having flat upper and lower surfaces:

a plurality of parallel electrically conductive bridges spanning said ribbon from one edge to the other and connected electrically to said edges of said ribbon: and means for applying a magnetic field in the direction perpendicular to the ribbon surfaces.

6. An electrical conductor apparatus according to claim 5, wherein said bridges are insulated from said ribbon surface.

7. An electrical conductor apparatus according to claim 5, wherein said bridges are of substantially identical widths.

8. An electrical conductor apparatus according to claim 5, wherein said bridges are insulated from adjacent bridges.

9. An electrical conductor apparatus according to claim 5 further comprising:

said electrical conductor configured into a spiral with individual segments insulated from adjacent portions and from ribbon surfaces;

a magnetic core having ferromagnetic core plates;

said conductor being wound around the magnetic core, with the ribbon surface positioned perpendicular to the magnetic core; and means for self generating a magnetic field.

10. An electrical conductor apparatus according to claim 9 further comprising:

said electrical conductor having insulator inserts containing ferromagnetic powder material with insulated material placed between facing surfaces to avoid an accidental short circuit; and means for self generating a magnetic field with a high reliability; thereby avoiding the possibility of causing short circuit, while assuring magnetic field penetration and coverage of the entire width of the modified ribbon conductor spiral.

11. An electrical conductor apparatus according to claim 5 further comprising:

a non-conductive semiconductor substrate;

said electrical conductor microscopically fabricated on said semiconductor substrate; and an externally supplied magnetic field along the direction perpendicular to the ribbon surface.

12. An electrical conductor apparatus according to claim 11, wherein said semiconductor substrate is silicon.

13. An electrical conductor apparatus according to claim 11, further comprising insulation material between said ribbon conductor and said electrically conductive bridges.

14. An electrical conductor apparatus according to claim 11, wherein said insulation is a silicon-containing material.

15. An electrical conductor apparatus according to claim 11, wherein said semiconductor substrate is gallium-arsenide.

16. An electrical conductor apparatus according to claim 5, wherein said electrical conductor apparatus is fabricated on a printed circuit board.

17. An electrical conductor apparatus according to claim 5, wherein said electrical conductor apparatus is fabricated on a chip substrate.

18. An electrical conductor apparatus according to claim 5, wherein said electrical conductor apparatus is fabricated on an interconnect circuit board.

19. A method of making an electrical conductor apparatus, comprising:

selecting a desired length of tubing;

angularly cutting and removing parallel segments from one side of the tubing, leaving alternating substantially equal width bands and gaps;

flattening the tubing to form a ribbon electrical conductor portion having flat upper and lower surfaces, with each band close to the ribbon, but contacting the ribbon only at each end of the band;

thereby forming a plurality of parallel bridges spanning the ribbon from one edge to the other and connected electrically to the edges of the ribbon.

20. A method according to claim 19, further comprising inserting insulator material between the bands and the ribbon.

* * * * *

UNITED STATES PATENT AND TRADEMARK OFFICE

CERTIFICATE OF CORRECTION

PATENT NO. : 5,321,310

DATED : June 14, 1994

INVENTOR(S) : Mikiso Mizuki

It is certified that error appears in the above-identified patent and that said Letters Patent is hereby corrected as shown below:

Column 2, line 46, between "along" and "migration", insert

-- the electron flow direction, (-y)-axis along the Hall current electron --.

In The Claims:

In Claim 2, column 7, line 59, after "claim", insert -- 1 --.

In Claim 10, column 8, line 40, change "circuit" to -- circuiting --.

Signed and Sealed this

Twenty-first Day of March, 2000

*Attest:*

*Attesting Officer*

Q. TODD DICKINSON

*Commissioner of Patents and Trademarks*